US006468128B1

(12) United States Patent
Bala et al.

(10) Patent No.: US 6,468,128 B1
(45) Date of Patent: Oct. 22, 2002

(54) COLLAPSIBLE CAR

(76) Inventors: Virginia M. Bala, 632 "C" St., Petaluma, CA (US) 94952; Russell G. Rasmussen, 632 "C" St., Petaluma, CA (US) 94952

( * ) Notice: Subject to any disclaimer, the term of this patent is extended or adjusted under 35 U.S.C. 154(b) by 0 days.

(21) Appl. No.: 09/524,899

(22) Filed: Mar. 14, 2000

(51) Int. Cl.[7] ..... A63H 17/26

(52) U.S. Cl. ..... 446/470; 446/95; 446/487; 446/465; 446/93

(58) Field of Search ..... 446/470, 93, 94, 446/95, 487, 488, 440, 431, 471, 465, 451

(56) References Cited

U.S. PATENT DOCUMENTS 4,571,203 A * 2/1986 Murakami
4,578,046 A * 3/1986 Ohno
4,580,993 A * 4/1986 Ohno
4,586,911 A * 5/1986 Murakami
4,674,990 A * 6/1987 Ohno
6,350,171 B1 * 2/2002 Hippely et al. ..... 446/440

* cited by examiner

*Primary Examiner*—Derris H. Banks
*Assistant Examiner*—Ali Abdelwahed

(57) ABSTRACT

In one embodiment a collapsible toy car is provided with a front top portion, a rear top portion, and two side portions is provided. The front top portion is pivotally attached to the rear top portion via a hinge. The two side portions are pivotally attached to the front and rear top portion via a front and rear pivot assembly, respectively. When assembled the front, rear and two side portions form an upright, operational position. When a force, however, is applied downwardly on the collapsible toy, the front, rear and two side portions collapse forming a substantially planar, collapsed configuration. A latch may be provided in order to retain the collapsible toy car in its collapsed configuration. Similarly, the latch may be released in various ways to permit the collapsible toy car to return to its operation position.

20 Claims, 3 Drawing Sheets

COLLAPSIBLE CAR

FIELD OF THE INVENTION

This invention relates to toys and more particularly to toys which are capable of collapsing or folding into a relatively planar configuration and which tend to return elastically to their operational/modeled configuration.

BACKGROUND OF THE INVENTION

Toy cars are not relatively new to the toy industry. Manufacturers of such toy car brands as Match Box®, Racing Champions®, and Hot Wheels® have been making die cast metal toys for many years. As children began collecting these toy cars the introduction of accessory items spawned into the industry. Playsets and carrying cases provided children with the ability to play with numerous cars and to transport these cars from one place to another. While individually, the toy cars are relatively small, any collection of toy cars, playsets and carrying cases may be extremely bulky.

The introduction of miniature toy cars, such as those manufactured by the makers of Micro Machines®, may have been one attempt to solve this problem. With the advent of miniature toys, smaller playsets and carrying cases have been introduced into the toy industry. Although these miniature toys have the same features as normal die cast toys, they are fundamentally much smaller than the normal toys. Furthermore, only miniature toys are functionally fitted to be used in conjunction with these miniature playsets and carrying cases. Larger, normal sized toys are not properly formed for miniature playsets and are not capable of being stored in miniature carrying cases.

It is therefore an object of the present invention to provide toys, especially toy cars that are similarly sized to other toys but capable of being made compact when being transported. It is a further object of the present invention to provide full size playsets, playsets designed for normal sized die cast toys, but capable of being made compact when not in use. It is yet a further object of the present invention to provide carrying cases that are compact and are capable of transporting the compact cars.

Similar products, which consist of collapsible playsets and toys, fundamentally lack the ability to automatically return to an operational or modeled configuration. These collapsible playsets and toys require a user to assemble or continually unfold and fold the playsets and toys. It is therefore another object of the present invention to provide collapsible toys and playsets which are capable of collapsing by applying a downwardly force and automatically returning to their operational/modeled configuration when the downwardly force is removed.

SUMMARY OF THE INVENTION

In accordance with the present invention, there is provided a collapsible toy car including a front top portion, a rear top portion, and two side portions. The front top portion is pivotally attached to the rear top portion via a hinging means. The two side portions are also pivotally attached to the front and rear top portion via a front and rear pivot assembly means. When assembled the front, rear, and two side portions form an upright, operational/modeled configuration. When a force is applied downwardly upon the collapsible toy the front, rear and two side portions collapse forming a substantially planar, collapsed configuration.

In the preferred embodiment, the hinging means consists of a protruding neck member in the rear top portion, a notch in the front top portion and a compression pin. The compression pin fits into a bore in the protruding neck member and fastens to a pair of opposing apertures in the notch, thus forming a hinging pivot pin between the front top portion and the rear top portion.

The front and rear pivot assembly means preferably consists of a torsion spring attached to each end of a U-shaped pivot pin. The middle section of the U-shaped pivot pin attaches to either the front or rear top portion, while the legs of the U-shaped pivot pin are fastened to the side portions, respectively. The side portions rotate about the U-shaped pivot pin against a rotational force exerted by the torsion springs. The torsion springs, continuously exerting the rotational force against the side portions, tend to return the toy elastically to its operational configuration.

In another embodiment of the present invention, a latching means is employed to retain the toy in its collapsed configuration, when the downwardly force is removed. The latching means may be released by depressing a releasing means. Once the latching means is released, the collapsible car may elastically return to its operational configuration. While in the preferred embodiment toy cars are referred to the invention can be employed with other types of vehicles and is not limited to cars.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
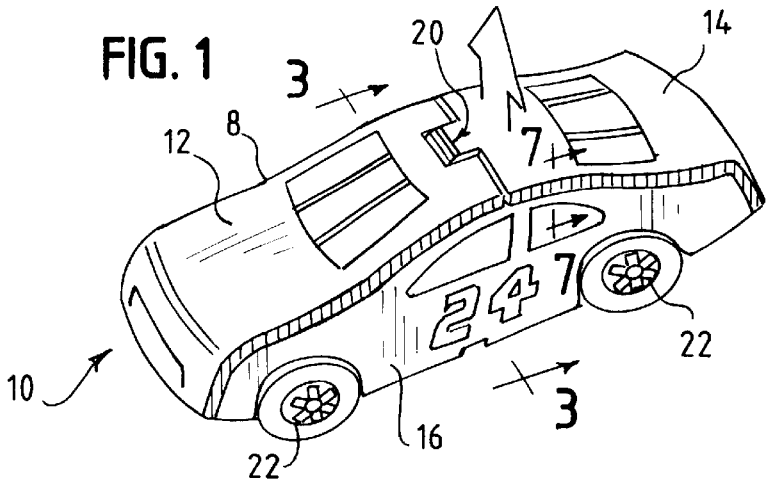
FIG. 1 is a perspective view of a collapsible car in its operational/modeled configuration.

While the invention is susceptible of embodiments in many different forms, there is shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Moreover, while the preferred embodiment discloses and describes a toy car, it is fully appreciated by the present invention that numerous variations and modifications to the design of the present invention may be made without diverging from the spirit and scope of the present invention, such as toy trucks, planes, jets, helicopters, spaceships, boats, military vehicles, weaponry, action figures, play sets and play environments, etc.

In the following description, similar components are referred to by the same reference number in order to simplify the understanding of the sequential aspect of the drawings.

Referring now to FIG. 1, a perspective view of the preferred embodiment according to the present invention is depicted. A toy collapsible car 10, generally referred to herein as the collapsible car, is shown in its operational configuration. Typically, the collapsible car is made from a die cast metal or plastic. In accordance with the spirit and scope of the invention, the collapsible car may be any size; however, in the preferred embodiment the collapsible car is similar in size to Match Box® and Hot Wheels® die cast cars.

The collapsible car 10 consists of a front top portion 12, a rear top portion 14 and two side portions 16 and 18. The front top portion 12 is pivotally hinged to the rear top portion 14 by a hinging means 20. Each side portion 16 and 18 is also pivotally hinged to the front top portion 12 and the rear top portion 14 by a front and rear attachment means (not shown), discussed in greater detailed below. The collapsible car also includes four wheels 22, two of which are attached to either side of the side portions.

When the collapsible car is in its operational configuration, the collapsible car resembles a normal die cast toy car, it is fully functional, meaning it may roll on its wheels. The front top portion 12 and rear top portion 14 resemble the same type of curvature of a normal car, with front and rear windshields, hood, trunk, and front and rear roof tops. The side portions 16 and 18 are in an upright position forming the sides of a car with doors and side windows. This configuration is referred to herein as the operational configuration. However, when a downwardly force is applied to a top portion of the collapsible car, either the rear top portion or the front top portion, the collapsible car collapses into a substantially planar configuration, referred to herein as its collapsible configuration.

Figure 2A:
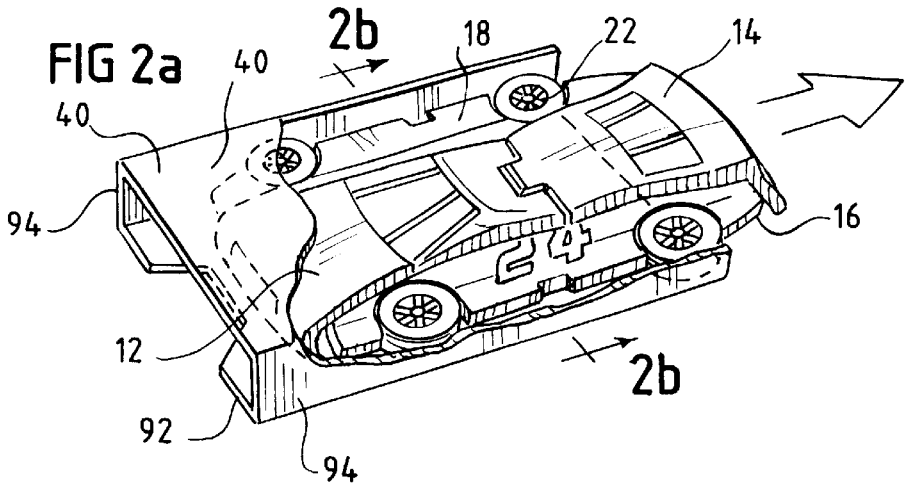
FIG. 2*a* is a perspective view of the collapsible car in its collapsible configuration.
Figure 2B:
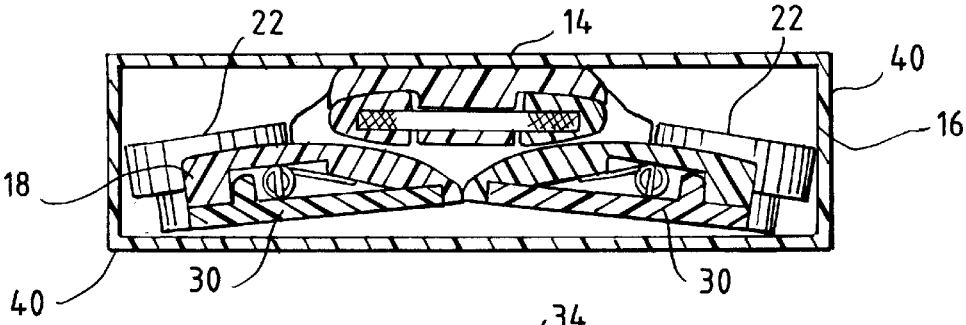
FIG. 2*b* is a cross-sectional view about section view 2*b*—2*b* in its collapsible configuration.

As shown in FIG. 2*a*, the collapsible car 10 is shown in its collapsible configuration. When a downward force is applied to the top portion of the collapsible car 10 the side portions 16 and 18 rotate from their upright position to a relatively flat position. While rotating, a section of both side portions 16 and 18 lie underneath the front and rear top portions 12 and 14, FIG. 2*b*. This allows for a relatively compact collapsible configuration. At the same time that the side portions rotate, the front and rear top portions 12 and 14 pivot about the hinging means 20 from their curved position to a relatively flat position. The rotation of the side portions and the pivot of the front and rear top portions transforms a normal sized die cast toy (car) into a flat, pocket sized car, which may be transported in a carrying case 40 not much larger than a credit card or wallet.

Figure 3:
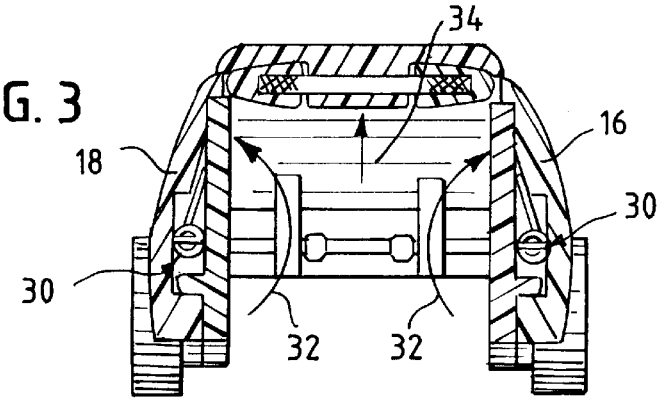
FIG. 3 is a rear cross-sectional view about section view 3—3 of the collapsible car in its modeled configuration.

When the collapsible car 10 is removed from the carrying case 40, or the downward force is removed from the top portion of the collapsible car, the collapsible car 10 automatically tends to return elastically to its operational configuration. FIG. 3 is a cross-sectional rear view of sectional line 3—3 from FIG. 1. FIG. 3 also depicts the forces that act upon the collapsible car to return the collapsible car from its collapsible configuration to its operational configuration. Attachment means 30 exert rotational forces 32 on the side portions 16 and 18 returning the side portions from their collapsed configuration to their upright configuration. Since a section of the side portions 16 and 18 lie underneath the front and rear top portions 12 and 14, when the side portions are rotating to their upright configuration they exhibit an upward force 34 on the bottom of the front and rear top portions pushing the front and rear top portions from their relatively planar configuration to their normal, curved, operational configuration. As such, the collapsible car returns elastically to its operational configuration.

Figure 4:
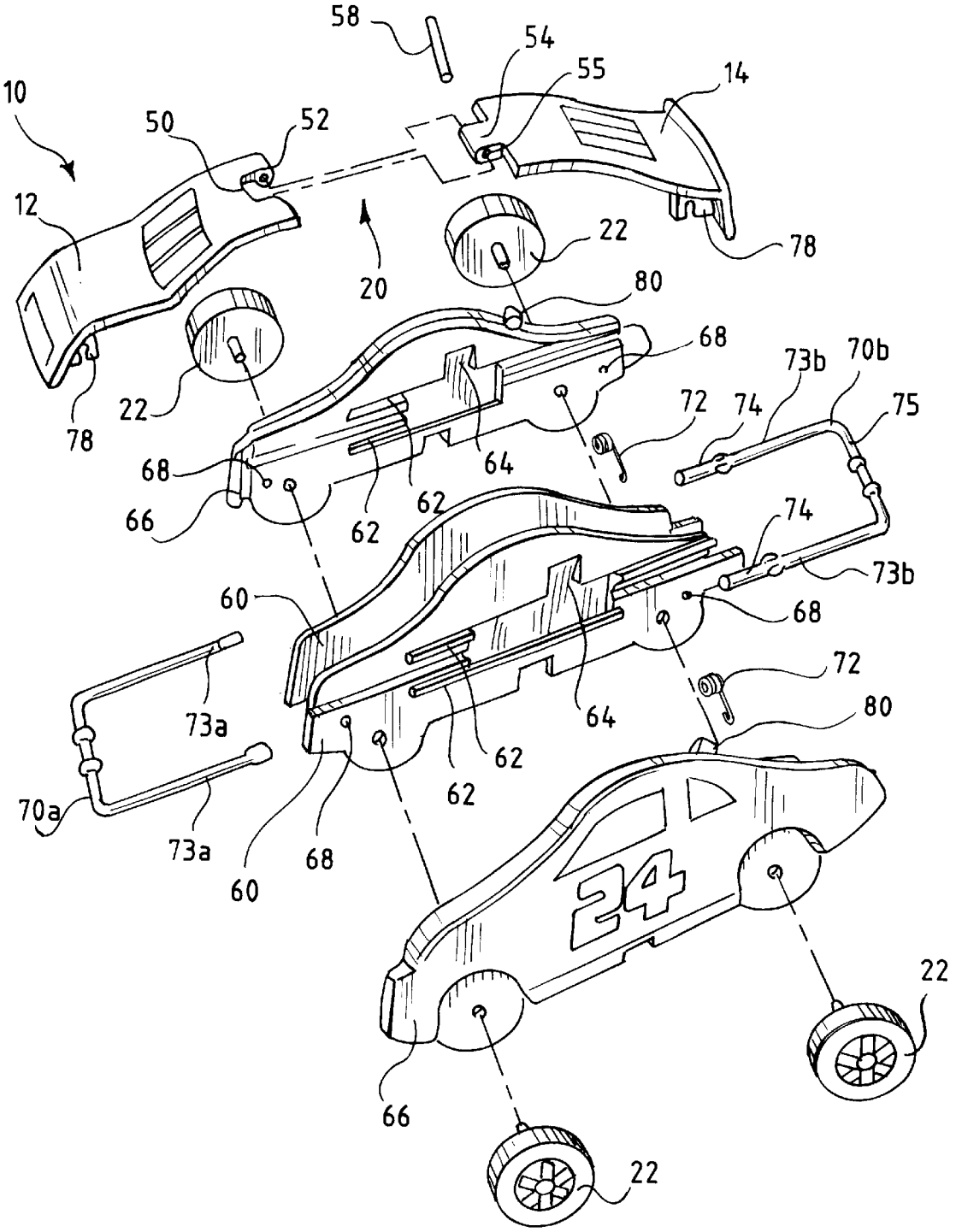
FIG. 4 is an exploded view showing various components of the collapsible car.

Referring now to FIG. 4, an exploded view of the collapsible car 10 is depicted. As shown, the front top portion 12 is pivotally hinged to the rear top portion 14 by the hinging means 20. In the preferred embodiment, the hinging means includes: a notch 50 on the front top portion 12, a protruding neck 54 on the reat top portion 14, and a compression pivot pin 58.

The compression pivot pin 58 is capable of being compressed, by a compression force, but has an internal spring mechanism which exerts a outward force, uncompressing the compression pivot pin 58 when the compression force is removed.

The notch 50 on the front top portion 12 has two apertures 52 that align with a bore 55 on the protruding neck 54. The compression pivot pin 58 slides into the bore 55 and is held in compression until the bore 55 aligns with the two apertures 52. Once the apertures 52 and the bore 55 are aligned, the compression pivot pin 58 is uncompressed, securing the front top portion 12 and the rear top portion 14 together, thereby pivotally hinging the front top portion 12 to the rear top portion 14. It should be understood that other hinging means well known in the art may be used to pivotally connect the front and rear top portions.

In the preferred embodiment, the side portions 16 and 18 are each made up of an inside panel 60 and an outside panel 66. The inside and outside panels 60 and 66 include channels 62 and recesses 64 that align when the inside and outside panels are connected together. The panels 60 and 66 are connected via a connecting means 68, which snaps the inside and outside panels 60 and 66 together. The front and rear attachment means 30 are housed within the channels 62 and recesses 64, discussed in greater detail below.

The front and rear attachment means 30 each preferably consist of a U-shaped pin 70*a* and 70*b*, respectively. Each U-shaped pin 70*a* and 70*b* has two ends 73*a* and 73*b* and a middle section 75. The middle section 75 of the U-shaped pin is secured respectively to either the front or rear top portions 12 and 14 by snaps 78, located on both the front and rear top portions. The ends 73*a* and 73*b* are housed in the channels 62 of the inside and outside panels 60 and 66.

Preferably the rear U-shaped pin 70*b* has a slit 74 on each end 73*b*. A torsion spring means defined by two torsion springs 72 are fastened to one end 73*b* of the rear U-shaped pin 70*b*, by inserting one end of the torsion spring 72 through the slit 74 on the end 73*b*. Each torsion spring 72 is housed in the recesses 64 of the inside and outside panels 60 and 66.

Figure 5:
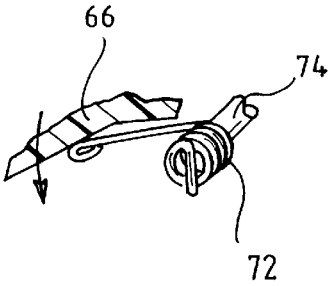
FIG. 5 is a perspective view of the torsion spring and outside panel while the collapsible car is in its collapsible configuration.
Figure 6:
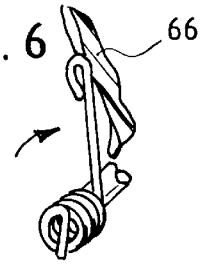
FIG. 6 is a perspective view of the torsion spring and outside panel while the collapsible car is in its operational configuration.

The torsion springs 72 are situated such that the springs exert a continuous rotational force on the outside panels 66 tending to elastically return the panels to their operational configuration, as seen in FIGS. 5 and 6. When a force is applied to the top portion of the collapsible car 10, FIG. 5, the outside panel 66 rotates about the end 73 of U-shaped pivot pin 70 against a rotational force exerted by the torsion springs 72. Once the force is removed, FIG. 6, the rotational force exerted by the torsion springs 72 returns the outside panels 66 to their operational configuration.

Figure 7:
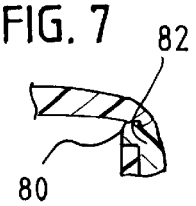
FIG. 7, is a front cross sectional view about section view 7—7 of the interconnection between one of the side panels and the rear top portion of the collapsible car.

As mentioned above, when the two side portions 16 and 18 return from their collapsible position to their operational position, the side portions exert an upward force on the front and rear top portions 12 and 14. In order to stop the side portions from rotating past their operational position, the outside panels 66 of the side portions 16 and 18 have a protruding wedge 80 which moves in a depression 82 in the rear top portion 14, FIG. 7. When the wedge 80 contacts the edge of the depression 82, the outside panels 66 are prohibited from rotating further.

Similarly, a storage case 40 is provided for transporting or storing at least one collapsible car in its collapsible configuration. One such storage case may be seen in FIG. 2*a*. The storage case 40, shown to hold only one collapsible car, has a top wall 90, bottom wall 92, and two side walls 94. The collapsible car is placed in the storage case in its collapsed configuration thereby provided a compact storage case. In order to retrieve the collapsible car the user would have to push or pull the collapsible car from one end of the storage case. As soon as the collapsible car is pushed or pulled from the storage case, the car elastically returns to its operational configuration.

In an alternative embodiment of the preferred invention, the storage case includes a spring and a release button. When the collapsible car is in the storage case the spring is compressed and held in place until the release button is depressed. Depressing the release button releases the compressed spring and pushes the collapsible car out of the storage case. When the collapsible car is pushed out of the storage case the collapsible car elastically returns to its operational configuration, thus providing a means of storing and launching the collapsible car from its collapsed configuration to its operational configuration.

Figure 8:
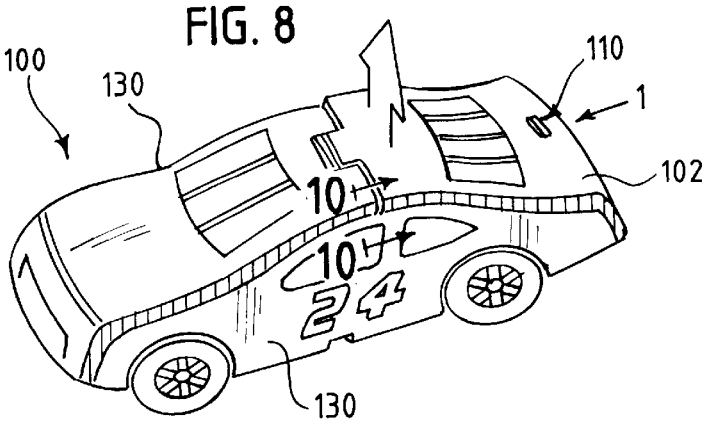
FIG. 8 is a perspective view of a collapsible car with a latching means.

Referring now to FIG. 8, in an alternate embodiment of the present invention a collapsible car 100 is depicted in its operational position. Since it may be desirous to hold the collapsible car 100 in its collapsible configuration without a constant downward force and without the use of a storage case, a latching means may be employed. When the downwardly force is applied to the top portion of the collapsible car 100, the latching means engages and retains the two side portions 130 in their substantially planar, collapsed configuration. In order to return the collapsible car 100 to its operational position a releasing means 110 is pressed, which disengages the latching means and permits, as previously described, the collapsible car to elastically return to its operational position.

Figure 9:
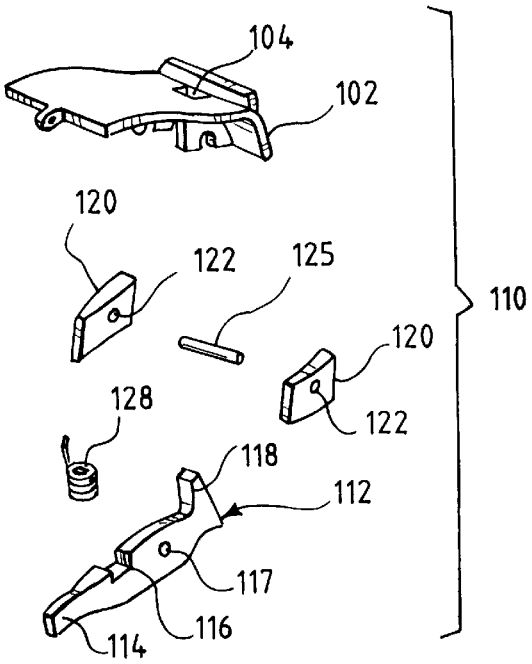
FIG. 9 is an exploded view of FIG. 8 showing various components of the latching means and the rear top portion of the collapsible car.

Best seen in the exploded view of FIG. 9, the latching means and the releasing means 110 is defined by a latching and releasing member 112, two side members 120, a pivot pin 125, and a compression spring 128. The latching and releasing member 112 has a latching arm 114, a notch 116 and a releasing protrusion 118. Position between the notch 116 and the releasing protrusion 118, the latching and releasing member 112 further includes an opening 117, discussed in greater detail below.

When assembled the latching and releasing member 112 is placed between the two side members 120, which are mounted on the bottom side of the top rear portion 102 of the collapsible car 100. The pivot pin is inserted through aligned openings 122 in the two side members and opening 117 in the latching and releasing member 112.

Figure 10:
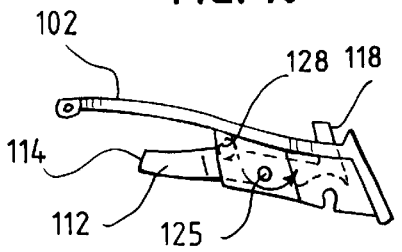
FIG. 10 is a side cross-sectional view about section view 10—10 of the collapsible car with latching means.

The compression spring 128 is housed in the notch 116 between the latching and releasing member 112 and the rear top portion 102. Illustrated in FIG. 10, the compression spring 128 acts outwardly against the latching and releasing member 112 and the rear top portion 102. This outward force causes the latching and releasing member 112 to pivot about pivot pin 125, forcing the releasing protrusion 118 through an aperture 104 in the rear top portion 102.

Figure 11:
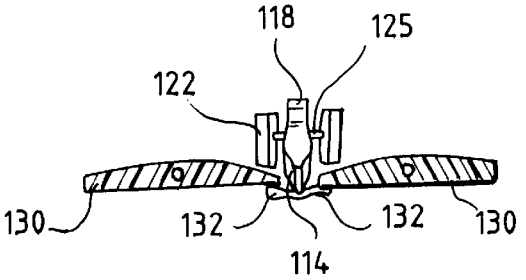
FIG. 11 is a partial rear view of the latching means and collapsible car while the collapsible car is in its collapsible configuration.

A downward force on the top portion of the collapsible car 100 will, as described above, place the collapsible car 100 in its collapsible position. As seen in FIG. 11, the protruding wedges 132 of the side portions 130 frictionally engages the latching arm 114, such that the side portions 130 are maintained in a relatively planar configuration, thus keeping the collapsible car in its collapsible configuration. A second downward force acting on the releasing protrusion 118 pivots the latching arm 114, disengaging the latching arm 114 from the protruding wedges 132. Once the two side portions 130 are released the collapsible car will elastically return to its operational position, as described above.

In addition, a collapsible playset is provided. The playset may consist of any specific play environment, for instance, typical environments for playsets may include, car garage, wrecking yard, car wash, racetrack, fire station, spaceports, railroad tracks, etc. In accordance with the present invention, the playset may be compressed by a downward force, similarly to the force exerted by a hand. While in the collapsed configuration the playset may be held in such a configuration by a latch or clasp. When the catch or clasp is released, the playset returns elastically to an operational configuration. In its operational configuration, the playset accommodates collapsible toy cars in their operational/modeled configuration as well as non-collapsible die cast toy cars.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A collapsible car comprising:

two top portions;

hinging means pivotally attaching the two top portions;

two side portions;

two pivot assembly means, each pivot assembly means pivotally attaching one of the two top portions to the two side portions; and a torsion spring means fastened to one of the two pivot assembly means, wherein the torsion spring means exerts a rotational force against the two side portions whereby the two top portions and the two side portions form an upright, operational position when attached, wherein a force applied downwardly against the collapsible car causes the two top portions and the two side portions to pivot about the two pivot assembly means forming a substantially planar, collapsed configuration.

2. The collapsible car of claim 1 wherein when the force is removed the rotational force exerted by the torsion spring means elastically returns the two top portions and the two side portions to the operational position.

3. The collapsible car of claim 2 wherein each pivot assembly means is defined by a U-shaped pivot pin having two ends and a middle section, wherein the two ends pivotally attach to the two side portions and the middle section pivotally attach to one of the two top portions.

4. The collapsible car of claim 3 wherein the torsion spring means includes two torsion springs fastened to each end of one of the U-shaped pivot pins.

5. The toy of claim 4 wherein each side portion consists of an outside and inside panel, such that the ends of the two U-shaped pivot pins are contained within the outside and inside panel.

6. The collapsible car of claim 5 wherein the hinging means comprises:

a notch in one of the top portions, the notch having two opposing apertures;

a protruding neck member in the other top portion, the protruding neck member having a bore; and a compression pin, wherein the compression pin slides in the bore of the protruding member and fastens to the two opposing apertures of the notch, thereby creating a pivot hinge between the two top portions.

7. The collapsible car of claim 6 wherein each outside panel has a protruding wedge and one of the two top portions has a depression for receiving the protruding wedge, the depression having an edge such that when the protruding wedge contacts the edge the pivotal movement of the side portions is halted.

8. The collapsible car of claim 7 further comprising a latching means attached to one of the two top portions, the latching means frictionally engaging the two side portions when the collapsible car is in the substantially planar collapsed configuration, such that rotational movement elastically returning the collapsible car to the operational position is prevented.

9. The collapsible car of claim 8 further comprising a means for releasing the latching means whereby the collapsible car can elastically return to the operational position.

10. The collapsible car of claim 9 wherein the latching means include a latching arm positioned horizontally between the two side portions wherein when the two side portions pivot to the substantially planar collapsed configuration, the wedges on the two side portions frictionally engage the latching arm such that the two side portions are prevented from rotating to the operational position.

11. The collapsible car of claim 10 wherein the releasing means includes a releasing protrusion attached to the latching arm such that when the releasing protrusion is depressed the latching arm disengages from the two side portions.

12. A collapsible toy comprising:

a top portion defined by a front panel hingedly connected to a rear panel; and two side panels;

a pivot assembly pivotally connecting the front panel to the two side panels; and a spring and pivot assembly pivotally connecting the rear panel to the two side panels, wherein the spring and pivot assembly exert a rotational force against the two side panels whereby the front, rear and two side panels form an upright, operational position when attached, and wherein a force applied downwardly on the collapsible toy pushes the front and rear panels outwardly away from each other and causes the two side panels to form a substantially planar configuration.

13. The collapsible toy of claim 12 wherein when the downwardly force is removed the rotational force exerted by the spring and pivot assembly elastically returns the collapsible toy to the operational position.

14. The collapsible toy of claim 13 wherein the side panels are defined by an inside panel and an outside panel, the inside panel and outside panel form a housing section that contains the pivot assembly and the spring and pivot assembly.

15. The collapsible toy of claim 14 further comprising a latching arm attached horizontally to the rear panel and between the two side panels, such that when the two side panels pivot to the substantially planar configuration, the latching arm frictionally engages the two side panels and prevents the collapsible toy from elastically returning to the operational position.

16. The collapsible toy of claim 15 further comprising a releasing protrusion attached to the latching arm, such that when the releasing protrusion is depressed the latching arm disengages from the two side panels whereby the collapsible toy can elastically return to the operational position.

17. A collapsible toy comprising:

a top portion;

two side portions; and two pivot assemblies, each pivot assembly attaching the top portion to the two side portions; and a rotational spring means being attached to one of the pivot assemblies, the rotational spring means exerting a rotational force against the two side portions whereby the top portion and the two side portions form an upright, operational position when attached, and wherein a force applied downwardly against the collapsible toy causes the top portion and the two side portions to pivot about the two pivot assemblies and form a substantially planar configuration.

18. The collapsible toy of claim 17 wherein the top portion includes a front top portion and rear top portion, the front top portion being hingedly secured to the rear top portion.

19. The collapsible toy of claim 18 wherein each side portion includes an inside panel and an outside panel, the inside panel and outside panel including channels, whereby when the inside panel and outside panel are secured together, the channels house the two pivot assemblies and the rotational spring means.

20. The collapsible toy of claim 19 further comprising:

a latching arm attached to the rear top portion and positioned horizontally between the two side portions, such that when the two side portions pivot to the substantially planar configuration, the latching arm frictionally engages the two side portions and prevents the collapsible toy from elastically returning to the operational position; and a releasing protrusion attached to the latching arm, such that when the releasing protrusion is depressed the latching arm disengages from the two side portions whereby the collapsible toy can elastically return to the operational position.

* * * * *